US008057259B2

(12) United States Patent
Konno et al.

(10) Patent No.: US 8,057,259 B2
(45) Date of Patent: Nov. 15, 2011

(54) RECEPTACLE CONNECTOR, PLUG CONNECTOR AND CONNECTOR APPARATUS

(75) Inventors: Takeshi Konno, Tokyo (JP); Katsuhiro Hori, Tokyo (JP); Masaaki Hayashi, Tokyo (JP)

(73) Assignee: Mitsumi Electric Co., Ltd, Tokyo (JP)

( * ) Notice: Subject to any disclaimer, the term of this patent is extended or adjusted under 35 U.S.C. 154(b) by 0 days.

(21) Appl. No.: 12/385,421

(22) Filed: Apr. 7, 2009

(65) Prior Publication Data

US 2009/0264022 A1 Oct. 22, 2009

Related U.S. Application Data

(60) Provisional application No. 61/064,997, filed on Apr. 8, 2008.

(51) Int. Cl.
*H01R 13/648* (2006.01)

(52) U.S. Cl. ..... 439/607.35

(58) Field of Classification Search ..... 439/607.34–607.52, 607.54
See application file for complete search history.

(56) References Cited

U.S. PATENT DOCUMENTS 5,236,375 A 8/1993 Kachlic
6,939,177 B2 * 9/2005 Kato et al. ..... 439/638
2007/0054553 A1 3/2007 Nishio et al.
2007/0298658 A1 * 12/2007 Iino et al. ..... 439/607
2008/0032540 A1 2/2008 Fukushima

FOREIGN PATENT DOCUMENTS

EP 0 676 828 A2 10/1995
EP 1 134 851 A1 9/2001
GB 2 391 402 A 2/2004
JP 2007-149602 A 6/2007

OTHER PUBLICATIONS

Printed pages from Freedictionary.com, copyright 2010.*
"IEEE Standard for a High-Performance Serial Bus-Amendment 2", IEEE Std 1394b 2002, pp. 1-369, The Institute of Electrical and Electronics Engineers, Inc., New York, NY.

* cited by examiner

*Primary Examiner* — Ross Gushi
(74) *Attorney, Agent, or Firm* — The Nath Law Group; Jerald L. Meyer; Stanley N. Protigal

(57) ABSTRACT

A receptacle connector prevents a plug from being obliquely inserted with a simple configuration. Receptacle connector 100 has: a hollow rectangular shape shield case (120) which is made by machining a metal plate and which includes fitting slot 101; and a housing (110) which is covered by the shield case (120) and in which contacts (130) to be connected with terminal parts (230) of an inserted plug (200) are disposed. In the shield case (120), a projecting part (124) is formed extending along one side of the fitting slot (101) by denting an upper plate part (122), which defines the accommodating part (104) accommodating the plug (200), to project toward an accommodating region (104). An end surface (124*a*) of this projecting part (124) on the fitting slot (101) side is closer to the fitting slot (101) side than the contacts (130) and forms a plane orthogonal to the upper plate part (122).

2 Claims, 4 Drawing Sheets

RECEPTACLE CONNECTOR, PLUG CONNECTOR AND CONNECTOR APPARATUS

CROSS REFERENCE TO RELATED APPLICATIONS

This application claims the benefit of U.S. Provisional Patent Application No. 61/064,997, filed on Apr. 8, 2008, the disclosure of which is hereby incorporated by reference.

BACKGROUND OF THE INVENTION

1. Field of the Invention

The present invention relates to an interface connector used to connect between electronic devices such as AV (Audio Visual) equipment. More particularly, the present invention relates to a receptacle connector, plug connector and connector apparatus to be connected with a plug connector.

2. Description of the Related Art

It is known that some electronic devices such as portable AV equipment including digital cameras are connected with a personal computer through a cradle. The electronic devices are connected through a cradle by fitting the plug connector for the cradle (hereinafter, also referred to as "plug" as appropriate) into the receptacle connector of the electronic device body (hereinafter, also referred to as "receptacle" as appropriate).

The receptacle has contacts arranged to meet the terminals of the plug to be inserted, in a shield case having a fitting slot that is open in one surface and that fits with the plug to be inserted. The contacts of the receptacle are arranged on a flat base of a housing disposed in the shield case.

When the plug is inserted in the receptacle, this base is inserted in the insertion region formed in the shield case of the plug. The base inserted in the insertion region connects the contacts on the base with the terminals of the plug seen in the insertion region in the plug.

The fitting slot of the receptacle is generally formed in a rectangular frame shape, and, to match this shape, the part of the plug that is inserted in the insertion slot of the receptacle and that is surrounded by the shield case, is formed in a rectangular flat shape.

Therefore, when the plug is inserted obliquely in the receptacle, there is a problem that the housing, which is the portion of the plug that is inserted, hits the housing of the receptacle.

When the housing of the plug hits the housing of the receptacle, there is a problem that the contacts of the receptacle buckle, thereby causing a problem that labor of fixing the buckle and replacing the buckled contacts is required when the contacts buckle.

SUMMARY OF THE INVENTION

It is therefore an object of the present invention to provide a receptacle connector, plug and connector apparatus that prevent a plug from being obliquely inserted with a simple configuration.

To achieve the above object, a receptacle connector according to the present invention that fits and electrically connects with a plug connector which is inserted from a fitting slot, includes: a hollow rectangular shape shield case which is made by machining a metal plate and which comprises the fitting slot; and a housing which is covered by the shield case and in which contacts to be connected with terminal parts of the inserted plug connector are disposed, and employs a configuration where: a projecting part is formed extending along one side of the fitting slot by denting one wall part, which defines the accommodating region accommodating the plug connector, to project toward an accommodating region in the shield case; and an end surface of the projecting part on a fitting slot side is closer to the fitting slot side than the contacts and forms a plane orthogonal to the one wall part.

To achieve the above object, a plug connector according to the present invention that is inserted in a fitting slot of a receptacle connector of the above configuration to fit and electrically connect with the receptacle connector, includes: an insertion part which comprises a concave part that is accommodated in an accommodating region of the receptacle connector through the fitting slot and that, when the concave part is accommodated in the accommodating region, fits in a projecting part of one wall part of a shield case, in an outer surface facing the one wall part of the shield case defining the accommodating region; and terminal parts which are provided in the insertion part and which connect with contacts of the receptacle connector when the insertion part is accommodated in the accommodating region. Further, to achieve the above object, the present invention includes: a receptacle connector of the above configuration; and a plug connector of the above configuration.

DETAILED DESCRIPTION OF THE PREFERRED EMBODIMENT

Figure 1:
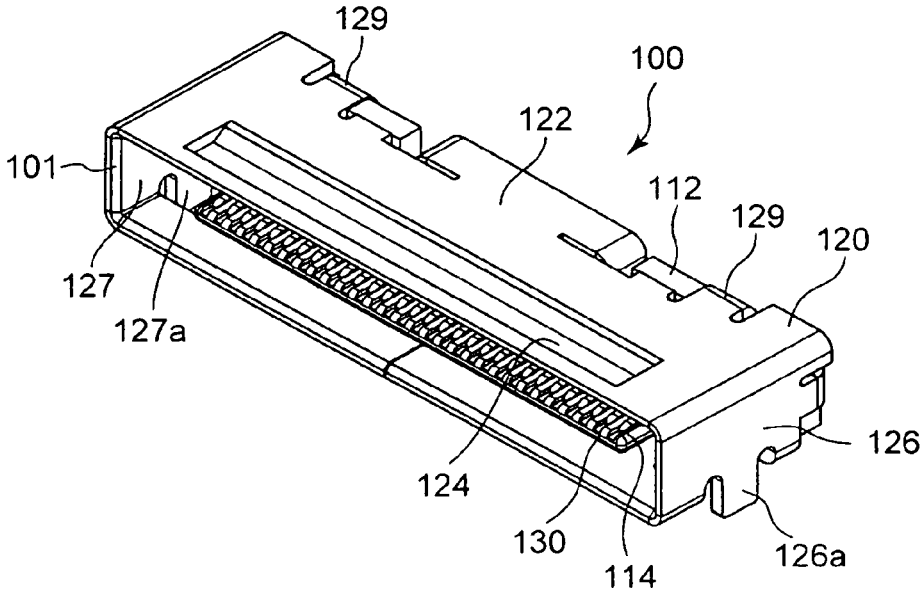
FIG. 1 is a perspective view of a receptacle connector according to the present invention.

Hereinafter, an embodiment of the present invention will be explained in detail with reference to the accompanying drawings.

With receptacle connector (hereinafter, "receptacle") 100 shown in FIG. 1 to FIG. 4, housing 110, which has base part 112 and flat base 114 projecting from the front surface of base part 112, is surrounded by rectangular, hollow rectangular shape shield case 120. By this means, receptacle 100 is formed with housing 110 and shield case 120 in a box shape which is open in one surface to form the insertion slot (i.e. fitting slot 101), fits with the electronic component inserted from this insertion slot (i.e. fitting slot 101), a plug connector (hereinafter, "plug") in this case, and electrically connects with the plug.

In housing 110, long, thin and flat contacts 130 extending in the fitting direction (corresponding to the insertion direction) are disposed to expose on one surface (i.e. surface) of base 114 and are guided from base part 112 to the outside on the base part side to form lead parts 133. These contacts 130 are arranged in base 114 at predetermined intervals in a direction orthogonal to the insertion direction.

In region 104 defined by one surface (i.e. surface) of base 114 in which contacts 130 are disposed and the inner surface (inner surface of upper plate part 122) of shield case 120 facing this one surface, when the projecting plate part in which terminals of the plug are disposed is inserted, contacts 130 are connected with the terminals of the plug.

In upper plate part 122 of shield case 120 facing one surface of base 114 in which contacts 130 are aligned in a row at predetermined intervals in the horizontal direction (i.e. width direction), projecting part 124 projecting toward region 104 is formed.

Projecting part 124 is formed in upper plate part 122 extending along the rim part of fitting slot 101 of receptacle 100. Projecting part 124 is formed by hammering upper plate part 122 from the surface side to dent. In other words, projecting part 124 is formed in upper plate part 122 by drawing machining.

Figure 2:
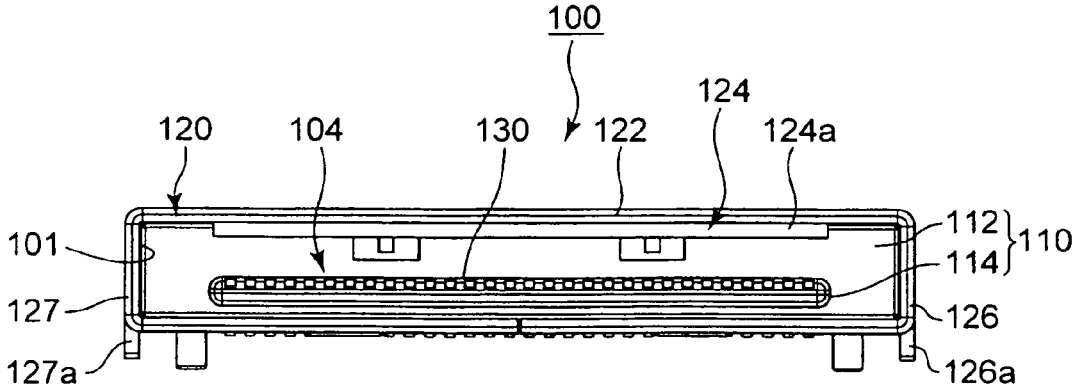
FIG. 2 is a front view of the receptacle connector according to the present invention.
Figure 3:
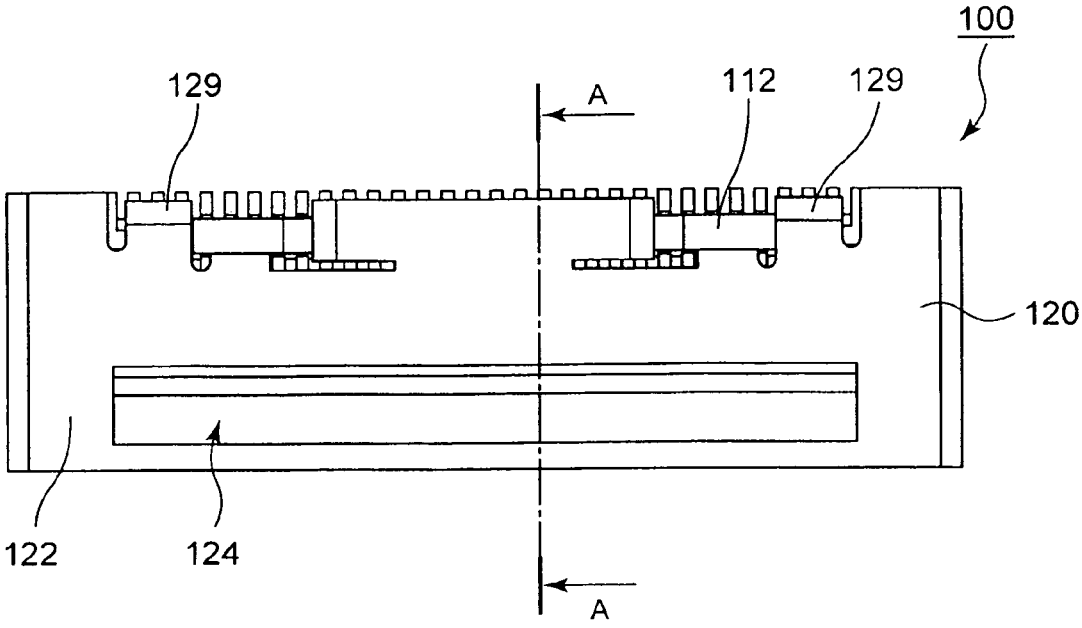
FIG. 3 is a top view of the receptacle connector according to the present invention.
Figure 4:
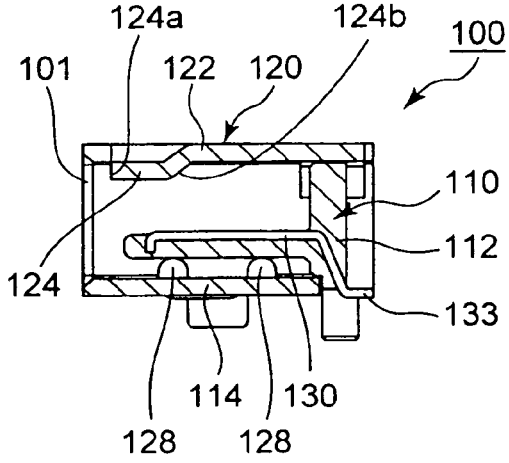
FIG. 4 is an A-A line cross-sectional view of FIG. 3 seen from the direction of an arrow.

As shown in FIG. 2 and FIG. 4, end surface 124*a* of projecting part 124 on the fitting slot 101 side forms a plane virtually orthogonal to upper plate part 122. That is, end surface 124*a* of projecting part 124 is formed as a plane orthogonal to the insertion direction of the plug that is inserted in region 104 through fitting slot 101. Further, as shown in FIG. 4, this end surface 124*a* of projecting part 124 is arranged in shield case 120 closer to the insertion slot (i.e. fitting slot 101) side than the end part of base 114 on the insertion slot (i.e. fitting slot 101) side. Further, preferably, the location of end surface 124*a* is closer to the insertion slot (i.e. fitting slot 101) side than contacts 130 of base 114. Further, end surface 124*b* (see FIG. 4) of projecting part 124 on the insertion direction side forms an inclining surface that approaches the upper surface of upper plate part 122 toward the depths.

Further, shield case 120 is formed in a hollow rectangular shape by bending a metal plate and the bottom surfaces of side plate parts 126 and 127 are cut and raised to form leg parts 126*a* and 127*a*. One opening part of shield case 120 forms fitting slot 101 as an insertion slot for electronic components such as a plug. When receptacle 100 is mounted on a substrate, leg parts 126*a* and 127*a* are inserted in notch parts formed in the substrate and fixed.

Further, as shown in FIG. 4, convex parts 128 projecting toward upper plate part 122 are provided on the upper surface of the bottom plate part of shield case 120, and convex parts 128 support base 114 of housing 110 placed on convex parts 128, in predetermined positions. Further, shield case 120 is fixed to housing 110 by engaging fixed claw parts 120 (see FIG. 1 and FIG. 3) provided in portions on the depth side with the rear surface of base part 112 of housing 110.

Figure 5:
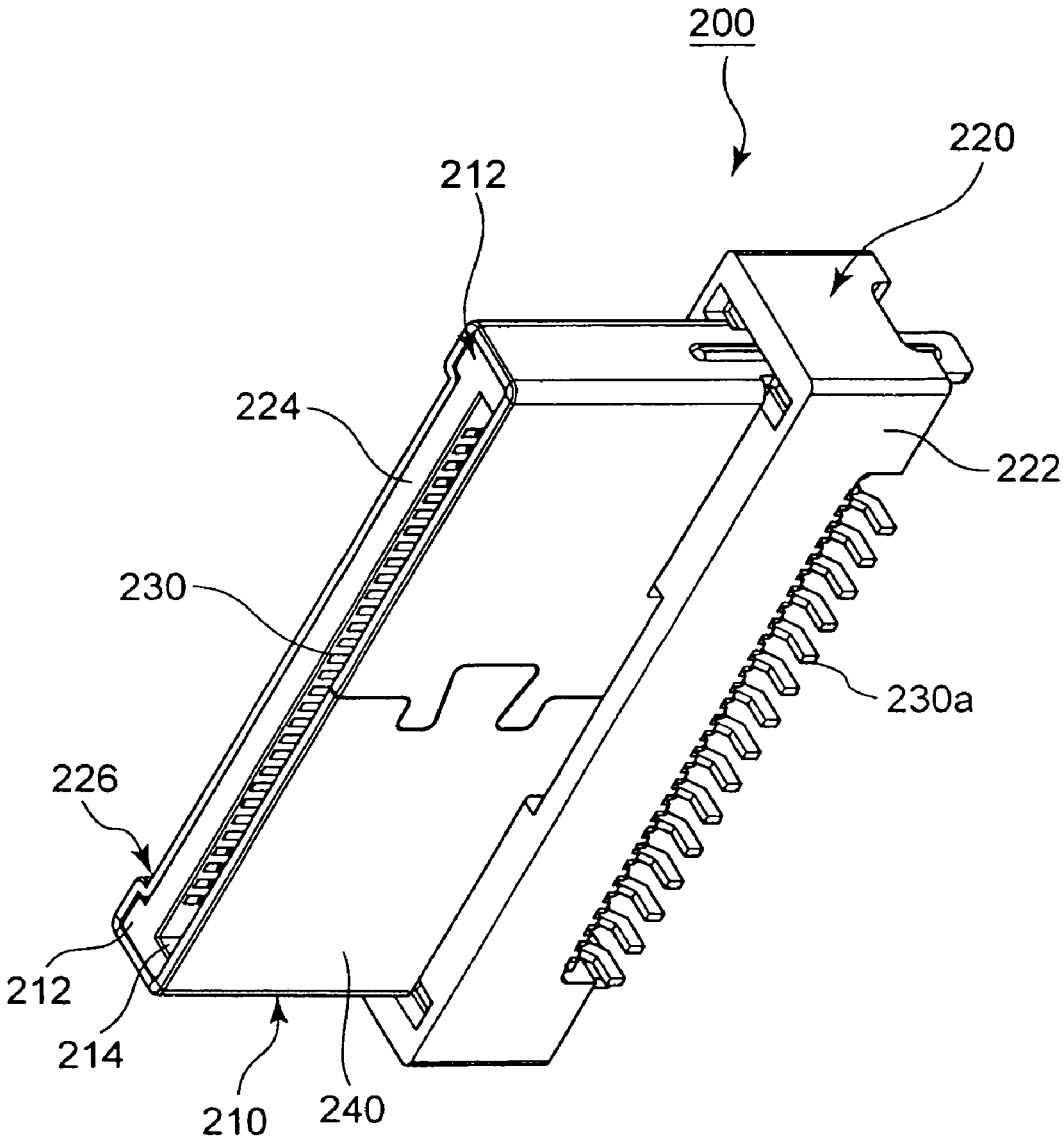
FIG. 5 illustrates a plug connector to be connected with the receptacle connector according to the present invention.

FIG. 5 shows an example of plug 200 as an electronic device to be connected with receptacle 100 according to an embodiment of the present invention. This FIG. 5 is a perspective view of plug 200 seen from the lower surface.

Plug 200 shown in FIG. 5 is formed in relationship to receptacle 100, and, in insertion part 210 that is inserted in shield case 120 (see FIG. 1 to FIG. 4) of receptacle 100, concave part 226 is formed in the portion (upper surface portion) meeting projecting part 124 of shield case 120.

To be more specific, plug 200 has: housing 220 which has rectangular parallelepiped base part 222 and flat insertion projecting part 224 projecting from the front surface of base part 222; a plurality of plug-side terminal parts 230 disposed to meet contacts 130 (see FIGS. 1, 2 and 4) of receptacle 100 (see FIG. 1 to FIG. 4), which is the target to connect with; and shield case 240 surrounding insertion projecting part 224.

Plug-side terminal parts 230 are arranged in one surface (i.e. lower surface) of insertion projecting part 224 of the housing and aligned in the direction orthogonal to the insertion direction, that is, the width direction (i.e. horizontal direction) of plug 200, and the one surface (i.e. lower surface) of insertion projecting part 224 and shield case 240 define insertion region 214 that accommodates base 114 when fitting into receptacle 100. Seen from the front end side, that is, seen form the open side, the upper surface part of insertion projecting part 224 is formed in a concave shape in relationship to convex parts 226 of the upper plate part of shield case 240, and insertion projection part 224 is formed by insertion region 214 in an H-shape that is open downward in the lower surface. By this means, seen from the front end side, that is, seen from the open side, insertion projecting part 224 is formed in an H-shape in concave shield case 240.

Further, one end parts of plug-side terminal parts 230 (i.e. end parts of plug-side terminal parts 230 on the depth side of plug 200) are guided outside from the rear surface of base part 222 in housing 220 to form lead parts 230*a* that are connected with the wirings on the substrate on which the plug is mounted.

Concave part 226 is formed in the center portion of the upper surface part of shield case 240 in the width direction and is not formed in both side parts in the upper surface part of shield case 240 along the insertion direction. By this means, seen from the front end side, that is, seen from the open side, shield case 240 is formed in the upper surface in a dented concave shape. Insertion part 210 is formed by arranging H-shaped insertion projecting part 224 in shield case 240 of such a shape, and the both side parts along the insertion direction of this insertion part 210 function as a limb for the upper surface part of shield case 240 by means of the convex parts formed in the both side parts of concave part 226 and the convex parts are further reinforced by the both side parts of insertion projecting part 224 solidly disposed inside. With this configuration, both corner parts 212 of insertion part 210 on the front end side become solid thanks to shield case 240 and both side parts of insertion projecting part 224.

Shield case 240 forms insertion part 210 with insertion projecting part 224, and is inserted in shield case 120 of receptacle 100 by making concave part 226 of the upper surface side meet projecting part 124 of receptacle 100. At this time, in region 104 of receptacle 100 shown in FIG. 1, FIG. 2 and FIG. 4, the center portion of insertion projecting part 224 in which plug-side terminal parts 230 are disposed in the lower surface of insertion projecting part 224 are inserted.

Further, insertion region 214 (see FIG. 5) of plug 200 accommodates base 114 of the receptacle to be inserted.

In this way, plug 200 and receptacle 100 fit, and plug-side terminal parts 230 and contacts 130 that both face each other in shield case 120 and shield case 240 inside shield case 120 and that are disposed in insertion projecting part 224 and base 114, are electrically connected.

Plug 200 configured in this way and receptacle 100 form a connector apparatus.

In receptacle 100 (see FIG. 1 to FIG. 4) of the connector apparatus, projecting part 124 that projects toward the inner region accommodating plug 200 is formed along the opening rim of fitting slot 101 in which plug 200 is inserted, is formed in one side surface portion (here, upper plate part 122) of shield case 120 that defines one side surface of the inner region in which plug 200 (see FIG. 5) is inserted.

End surface 124*a* of projecting part 124 on the open side which is fittings lot 101 forms a plane orthogonal to upper plate part 122, that is, a plane orthogonal to the insertion direction of plug 200.

That is, receptacle 100 shown in FIG. 1 to FIG. 4 fits and connects electrically with plug 200 (see FIG. 5) that is inserted from fitting slot 101.

In this way, in the connector apparatus according to the present invention, receptacle 100 has: hollow rectangular shape shield case 120 which is made by machining a metal plate and which has the fitting slot; and housing 110 which is covered by shield case 120 and in which contacts 130 to be connected with terminal parts 230 of inserted plug 200 are disposed. Projecting part 124 is formed by drawing machining, projecting toward the accommodating region and extending along fitting slot 101 in one wall part (i.e. upper plate part 122) that defines the accommodating region accommodating inserted plug 200 in shield case 120, and end surface 124*a* of projecting part 124 on the fitting slot 101 side forms a plane orthogonal to the insertion direction of the one wall part (i.e. upper plate part 122) or plug 200.

On the other hand, plug 200 (see FIG. 5) is formed to meet receptacle 100 (see FIG. 1 to FIG. 4), and includes insertion part 210 that is inserted in receptacle 100 from fitting slot 101 and concave part 226 that is formed in the portion (i.e. upper surface portion) of insertion part 210 meeting projecting part 124 of shield case 120. Insertion part 210 is formed by surrounding insertion projecting part 224 of housing 220 by shield case 240, and concave part 226 is a dent that is formed in the upper surface of shield case 240 and that is open upward and toward the front end side. That is, concave part 226 is formed in the upper surface part of shield case 240 to extend by a predetermined length in the width direction (here, the center portion of the upper surface part) from the front end side towards the depth side.

This concave part 226 is formed to meet projecting part 124 of receptacle 100, and, consequently, the depth of concave part 226 matches the length of projecting part 124 projecting from upper plate part 122 of shield case 120 of receptacle 100.

Figure 6:
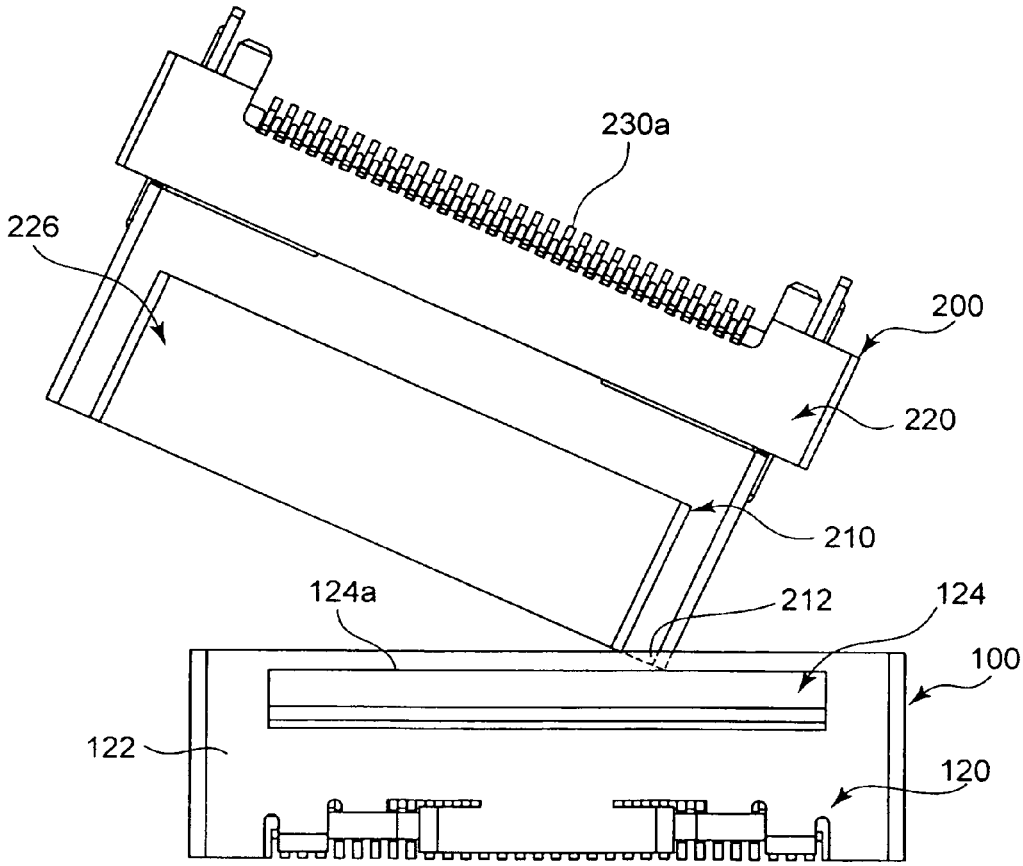
FIG. 6 shows a state where the plug connector obliquely fits in the receptacle connector according to the present invention.

As shown in FIG. 6, when plug 200 fits into receptacle 100 formed in this way, if plug 200 is inserted obliquely in receptacle 100, corner part 212 of the front end part of plug 200 (to be more specific, insertion part 210) abuts on end surface 124*a* (see FIG. 2 and FIG. 4) of projecting part 124 projecting inside shield case 120 near fitting slot 101 in receptacle 100.

That is, when plug 200 is inserted obliquely in receptacle 100, projecting part 124 of receptacle 100 interferes with the front end part of plug 200 near fitting slot 101. Consequently, receptacle 100 can prevent plug 200 to be inserted, from entering in an oblique state and fitting in an oblique state.

Consequently, plug 200 does not fit obliquely in receptacle 100, so that plug 200 to be inserted does not damage housing 110 of receptacle 100 (more particularly base 114) or contacts 130 disposed in base 114.

Even when the plug is inserted obliquely in receptacle 100 in this way, the housing of the plug does not hit the housing of the receptacle, so that the contacts of the receptacle do not buckle. Consequently, it is not necessary to fix the buckle of the contacts of the receptacle or replace the buckled contacts.

Further, with receptacle 100 of the present embodiment, only by applying drawing machining to shield case 120, which is made by processing a metal plate, to form projecting part 124 which extends along the rim part of fitting slot 101 and which projects toward the accommodating region of the plug, it is possible to prevent a plug from being obliquely inserted at ease.

What is claimed is:

1. A receptacle connector, comprising:

a shield case having a rectangular shape, formed of a metal plate and defining a fitting slot and an inner space, a plug connector being inserted from an opening of the fitting slot to fit and electrically connect with the receptacle connector, and accommodated in the inner space;

a housing covered by the shield case and having a plurality of contacts that connect with terminal parts of the inserted plug connector, the plurality of contacts being arranged along a direction orthogonal to a direction of insertion of the plug connector in the fitting slot, and facing one wall part of the shield case, wherein:

the one wall part of the shield case comprises a projecting part that is formed by bending a part of the one wall part inward to dent into the inner space; and one end surface of the projecting part faces the opening of the fitting slot, orthogonal to the one wall part, extends along the direction orthogonal to the direction of insertion of the plug connector in the fitting slot and along a direction in which the plurality of contacts are disposed in the housing, and is situated distant from the opening of the fitting slot, closer to the opening of the fitting slot than the plurality of contacts.

2. A connector apparatus comprising:

the receptacle connector of claim 1; and a plug connector structured to be inserted in the fitting slot of the receptacle connector to fit and electrically connect with the receptacle connector.

* * * * *